US007121347B2

(12) United States Patent
Murray et al.

(10) Patent No.: US 7,121,347 B2
(45) Date of Patent: Oct. 17, 2006

(54) LIQUID SAMPLER

(75) Inventors: Paul Anthony Murray, Charlotte, NC (US); Stephen Wayne Smith, Huntersville, NC (US); Peter Geoffrey Griffiths, Cornelius, NC (US); Patrick Wakefield Nevins, Mooresville, NC (US)

(73) Assignee: AEA Technology Engineering Services, Inc., Pittsburgh, PA (US)

( * ) Notice: Subject to any disclaimer, the term of this patent is extended or adjusted under 35 U.S.C. 154(b) by 44 days.

(21) Appl. No.: 10/781,943

(22) Filed: Feb. 20, 2004

(65) Prior Publication Data

US 2005/0183861 A1 Aug. 25, 2005

(51) Int. Cl.
*E21B 49/08* (2006.01)

(52) U.S. Cl. ..... 166/372; 166/68; 166/264; 417/58

(58) Field of Classification Search ..... 166/369, 166/370, 372, 381, 383, 68, 264, 105, 192, 166/193, 153, 325; 417/56, 58
See application file for complete search history.

(56) References Cited

U.S. PATENT DOCUMENTS

| | | | | |
|---|---|---|---|---|
| 2,026,419 | A * | 12/1935 | Davidson | 166/305.1 |
| 2,669,936 | A * | 2/1954 | Elkins et al. | 417/320 |
| 3,263,753 | A * | 8/1966 | Corley, Jr. | 166/147 |
| 3,367,421 | A * | 2/1968 | Raulins | 166/153 |
| 3,372,753 | A * | 3/1968 | Tuttle | 166/370 |
| 3,394,760 | A * | 7/1968 | Childers et al. | 166/383 |
| 3,863,714 | A * | 2/1975 | Watson, Jr. | 166/53 |
| 3,875,606 | A * | 4/1975 | Landers | 15/104.061 |
| 3,894,583 | A * | 7/1975 | Morgan | 166/68 |
| 3,941,510 | A * | 3/1976 | Morgan | 417/57 |
| 3,941,511 | A * | 3/1976 | Morgan | 417/57 |
| 3,991,825 | A * | 11/1976 | Morgan | 166/68 |
| 4,222,438 | A * | 9/1980 | Hollingsworth et al. | 166/264 |
| 4,389,461 | A * | 6/1983 | Scott | 428/543 |
| 4,498,932 | A * | 2/1985 | Kruka | 134/8 |
| 4,633,954 | A * | 1/1987 | Dixon et al. | 166/372 |
| 5,289,875 | A | 3/1994 | Stokley | 166/264 |
| 5,353,870 | A * | 10/1994 | Harris | 166/68 |
| 5,671,813 | A * | 9/1997 | Lima | 166/372 |
| 5,911,278 | A * | 6/1999 | Reitz | 166/372 |
| 6,352,109 | B1 * | 3/2002 | Buckman, Sr. | 166/372 |
| 6,830,108 | B1 * | 12/2004 | Rogers, Jr. | 166/372 |
| 2001/0004937 | A1 * | 6/2001 | Leniek | 166/369 |
| 2003/0183394 | A1 * | 10/2003 | Reitz | 166/370 |
| 2004/0123987 | A1 * | 7/2004 | Reitz | 166/370 |

FOREIGN PATENT DOCUMENTS

GB 2358450 A * 7/2001

* cited by examiner

*Primary Examiner*—Kenneth Thompson
(74) *Attorney, Agent, or Firm*—William H. Holt

(57) ABSTRACT

A method and an apparatus raise samples of liquid such as water from a low level to a higher level, for example for obtaining a sample of groundwater from a borehole. The apparatus comprises a pair of tubes (14 and 16) extending alongside each other, which are introduced into the borehole, linked by a connector (20) at their lower end, a valve (22) communicating between the inside and outside of one of the tubes (16) near its lower end, and a pig (46) insertable into the tube (16). By adjusting the pressure in each tube at their upper end, the pig (46) can be moved from one end to the other of the apparatus (10) and used to transfer samples of water.

5 Claims, 3 Drawing Sheets

LIQUID SAMPLER

BACKGROUND OF THE INVENTION

This invention relates to a method and an apparatus for raising a sample of liquid such as water from a low level to a higher level, for example for obtaining a sample of groundwater from a borehole.

A variety of methods are known for obtaining samples of liquids from boreholes. For example in the oil industry coiled tubing units are commonly used to transmit sample fluids from a particular zone in the borehole to the surface. Alternative techniques use a tool suspended on a wireline. Both these approaches are mentioned in U.S. Pat. No. 5,289,875 (Stokley et al). Such tools may incorporate packers to restrict the section of the borehole from which the fluid is obtained. However, such tools are complex, and it would be desirable to provide a simpler way of obtaining samples, which would be applicable over a wide range of different depths. The samples may be withdrawn for analysis, or alternatively the process may be repeated many times to empty a section of the borehole, that is to say using the sampler as a pump.

BRIEF SUMMARY OF THE INVENTION

According to the present invention there is provided an apparatus for raising a sample of liquid from a lower level to a higher level, the apparatus comprising a pair of tubes extending alongside each other, for extending from the higher level to the lower level, linked by a connector at their lower end, a valve communicating between the inside and outside of one of the tubes near its lower end, a pig insertable into one of the tubes at the upper end, and means at the upper end to adjust the pressure in each tube.

The pig may be of spherical or generally cylindrical shape, so it seals to the tube it is in. It may for example be of dense plastic foam with end faces of polytetrafluoroethylene (PTFE); such pigs are known per se, and are used to clean out tubes or pipes. An alternative pig comprises a polyurethane or steel rod linking flexible polyurethane discs.

The present invention also provides a method for raising a sample of liquid from a lower level to a higher level, using an apparatus comprising a pair of tubes extending alongside each other, linked by a connector at one end, a valve communicating between the inside and outside of one of the tubes near the one end, a pig insertable into one of the tubes at the other end, and means at the said other end to adjust the pressure in each tube, the method comprising the steps of arranging the tubes so that the connector is at the lower level, inserting a pig into one of the tubes, adjusting the pressures so the pig moves to the end of the tubes adjacent to the connector, causing liquid to enter the tube through the valve, and then adjusting the pressures so the pig pushes the liquid that has entered the tube to the other end of the tube.

Thus in use, merely by adjusting the pressures at the upper ends of the tubes, the pig can be moved from one end of the tube to the other. The valve may be a simple check valve or non-return valve, so with the pig at the lower end of the tubes, application of reduced pressure opens the valve so that liquid enters the tube from the surroundings. Applying a pressure difference between the upper ends of the tubes can then push the pig along with the liquid that has entered the tube to the upper end of that tube. The tubes may be of considerable length, for example 900 m (3000 feet), but the pressure needed to raise the sample of water does not need to be large; it is effectively independent of the height difference between the top and bottom of the tubes.

In one embodiment the connector is a U-shaped turn block, so that the pig may be sent down one tube and returned up the other tube. Operation of this embodiment has the disadvantage that it is then necessary to transfer the pig from one tube to the other at the upper end (or use a new pig) if operation is to be repeated. In a preferred embodiment the pig remains in one tube throughout the operations, moving up and down that tube according to the changes in pressure. In this case the two tubes may be of different diameters. By repeating the pressure changes in a cyclic fashion liquid is effectively pumped from the lower level to the higher level, and so the apparatus may be used to empty a container.

The adjustments in pressure may be achieved using a supply of high-pressure gas, such as compressed air, combined with a jet pump for obtaining a reduced pressure. Alternatively, the adjustments in pressure may be achieved using pumps and compressors. The tubes are preferably flexible, and may therefore be stored coiled onto a reel.

BRIEF DESCRIPTION OF THE SEVERAL VIEWS OF THE DRAWINGS

The invention will now be further and more particularly described, by way of example only, and with reference to the accompanying drawings, in which:

FIG. 2*b* showing the step in which a sample of water is brought into the tube; FIG. 2*c* showing the step in which the pig and water are brought up; and FIG. 2*d* showing the step in which the sample of water is removed.

DETAILED DESCRIPTION OF THE INVENTION

Figure 1:
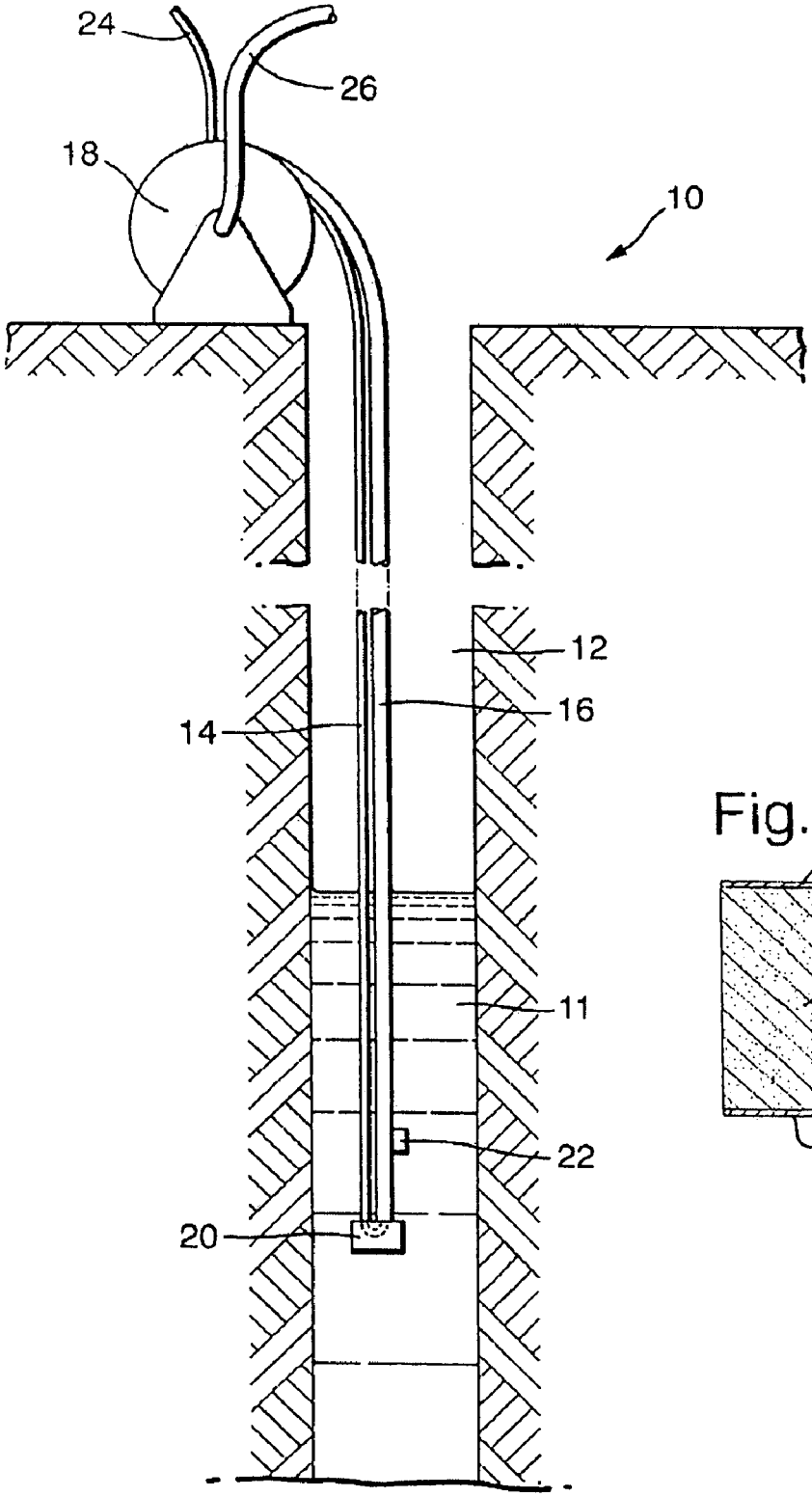
FIG. 1 shows the apparatus arranged to remove samples of water from a borehole.

Referring to FIG. 1, the apparatus 10 is shown for extracting samples of water 11 from a borehole 12. The apparatus 10 comprises two flexible tubes 14 and 16 which are supported at ground level coiled onto a reel 18, and which are introduced into the borehole 12 so as to extend down to below the surface of the water 11. By way of example, the borehole 12 may be many hundreds of meters deep, and the water level may be hundreds of meters below the surface. At their lower end, the tubes 14 and 16 communicate through a narrow-bore steel connector 20. One of the tubes, 16, is of wider internal diameter, and near the lower end of the tube 16 is a non-return valve 22 which would enable water 11 to enter the tube 16, but prevents fluids from leaving the tube 16. Pipes 24 and 26 emerge from the centre of the drum 18 at opposite ends, these pipes 24 and 26 communicating respectively with the flexible tubes 14 and 16, and are connected through valves to a device to control the pressure in each (not shown in FIG. 1).

Figure 3:
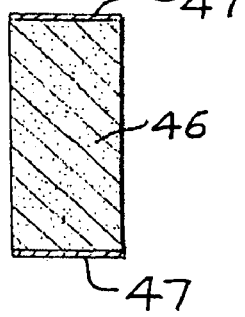
FIG. 3 shows a longitudinal sectional view of the pig of the apparatus of FIG. 1.
Figure 2A:
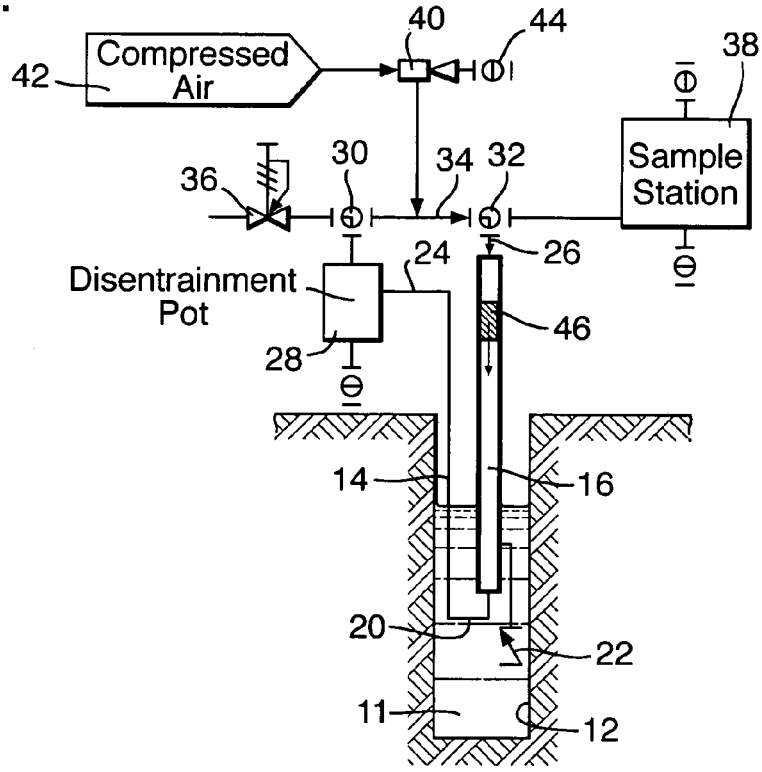
FIGS. 2*a* –2*d* show diagrammatically successive steps in the operation of the apparatus of FIG. 1, FIG. 2*a* showing the step in which the pig is being driven down to the bottom.

Referring now to FIG. 2*a*, in which the apparatus 10 is shown diagrammatically, the pipe 24 communicates via a disentrainment pot 28 with a three-way valve 30, while the pipe 26 communicates with a three-way valve 32. The valve 30 enables the pipe 24 to communicate either with a pressure control line 34 or with an adjustable outlet restrictor 36; while the valve 32 enables the pipe 16 to communicate either with the pressure control line 34 or with a sample station 38. The pressure control line 34 communicates with a jet pump 40 whose inlet is connected to a source of compressed air 42 and whose outlet is controlled by a valve 44. Hence if the valve 44 is open, compressed air flows through the jet pump 40, so the pressure in the control line 34 is reduced, while if the valve 44 is closed the compressed air flows into the pressure control line 34. The tube 16 contains a cylindrical pig 46 (shown to a larger scale in FIG. 3) of dense polyurethane plastic foam with PTFE end plates 47 which seal to the wall of the tube 16.

In the step shown in FIG. 2*a,* the valve 30 communicates with the outlet restrictor 36, the valve 32 communicates with the pressure control line 34, while the outlet valve 44 is closed. Consequently compressed air from the source 42 passes into the top end of the tube 16, and pushes the pig 46 down to the bottom end of the tube 16, where it comes to rest against the steel connector 20. Air displaced from the tube 16 passes up the tube 14 to emerge through the restrictor 36.

Figure 2B:
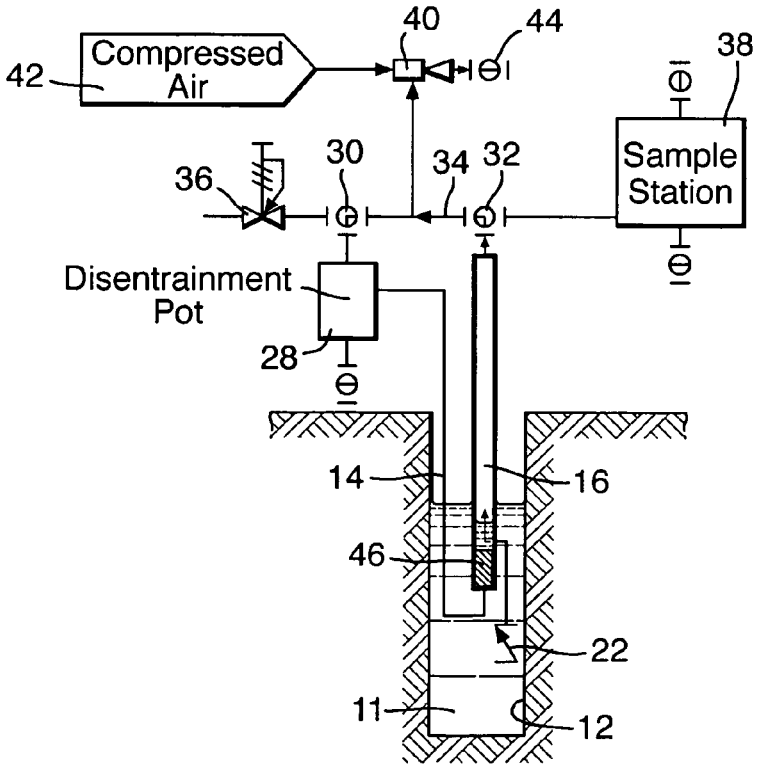

Referring now to FIG. 2*b,* in this step the valves 30 and 32 both communicate with the pressure control line 34, while the outlet valve 44 is open. The air flowing through the jet pump 40 considerably lowers the pressure in the pressure control line 34 and hence that in both the tubes 14 and 16. Consequently the pressure at the bottom of the tube 16 is lower than that of the water 11 at that depth, so water 11 from the borehole 12 enters the tube 16 through the non-return valve 22. The non-return valve 22 may be kept open in this way for sufficient time that the water level within the tube 16 becomes the same as or higher than that in the borehole 12; or alternatively the non-return valve 22 may be kept open for only a short period of time, so that only a small amount of water enters the tube 16. The water that enters the tube 16 is above the pig 46.

Figure 2C:
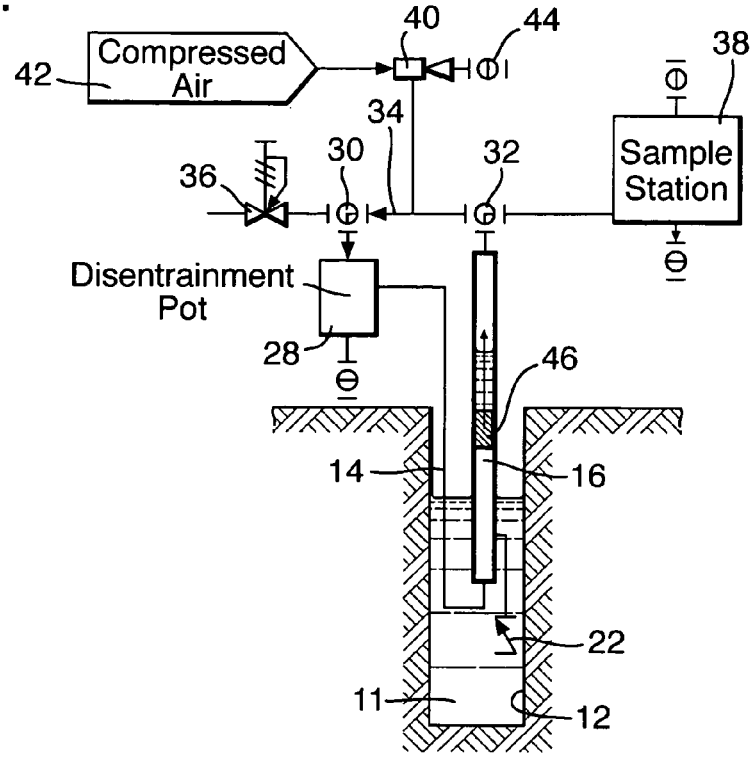

Referring now to FIG. 2*c,* in this step the valve 30 communicates with the pressure control line 34, the valve 32 communicates with the sample station 38, and the outlet valve 44 is closed. Consequently the compressed air flows down the tube 14 and pushes the pig 46 and the water that has entered the tube 16 up the tube 16. When the pig 46 reaches the top of the tube 16 the water therefore flows into the sample station 38.

Figure 2D:
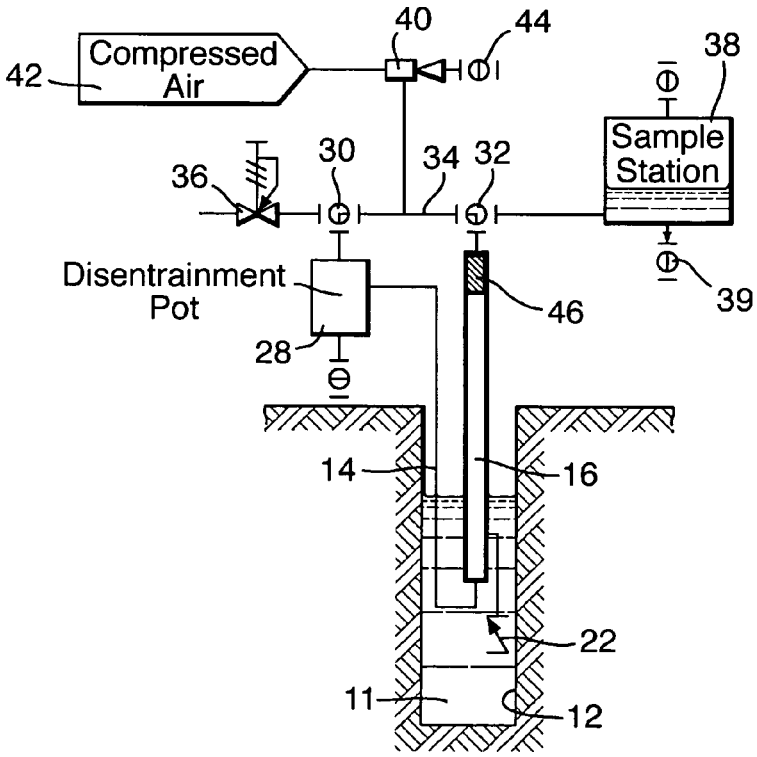

Referring now to FIG. 2*d,* the water sample is shown in the sample station 38 and the pig 46 is shown at the top of the tube 16. In this step both the valves 30 and 32 communicate with the pressure control line 34, while the outlet valve 44 is closed. The pressure is therefore high in both the tubes 14 and 16, and no gas flow takes place. By opening a valve 39 at the bottom of the sample station 38 the sample can be removed.

By repeating these steps, repeated samples of water are removed from the borehole 12. The sequence of operating the valves is as follows, starting at the step shown in FIG. 2*a*. When sufficient time has elapsed for the pig 46 to have reached the bottom of the tube 16, the valve 30 is changed to communicate with the pressure control line 34 (so the pressures are equal in both tubes 14 and 16) and then the outlet valve 44 is opened (as shown in FIG. 2*b*). When sufficient time has elapsed for water to enter the tube 16, the outlet valve 44 is closed and the valve 32 changed to communicate with the sample station 38 (as shown in FIG. 2*c;* the sequence of these valve changes is not critical). And then, when the pig 46 reaches the top of the tube 16 and the water has entered the sample station 38, the valve 32 is changed to communicate with the pressure control line 34. Finally, valve 30 is changed to communicate with the restrictor 36, so that the pig 46 is again pushed down the tube 16 (as shown in FIG. 2*a*).

It will be appreciated that the apparatus 10 may be modified in various ways while remaining within the scope of the present invention. For example the tubes 14 and 16 might instead be of equal diameter. In this case they may be linked by a U-tube of the same internal diameter, so that the pig 46 could go down one tube 14 and up the other, although this has the disadvantage that obtaining repeated samples of water would require the pig 46 to be transferred between the tubes at the top end. The tubes 14 and 16 may be completely removed from the reel 18 before operation, if they are of an appropriate length. Each of the three-way valves 30 and 32 may be replaced by a T-junction and a pair of two-way valves.

In some situations it is desirable to avoid lowering the pressure in the vicinity of the liquid, in order to avoid release of volatile organic compounds. In an alternative operating method, which avoids the need to lower the pressure, water is admitted into the tube 16 from the borehole 12 by the lowering the tubes 14 and 16 further into the borehole 12 and so further below the surface of the water 11 until the valve 22 is subjected to sufficient water pressure that it opens. Indeed, if the depth of submergence in the liquid 11 is greater than the desired length of liquid sample to be introduced into the pipe 16, there is no need to generate a reduced pressure (so the jet pump 40, 44 can be omitted), and it may well be appropriate to have an elevated pressure in the tube 16 throughout the operation cycle. In another alternative the non-return valve 22 is replaced by an actuated valve, and this may be actuated by pneumatic, electrical, or mechanical means; such an actuated valve also avoids the need to lower the pressure. As described above, the source of the pressure is the cylinder of compressed air 42, but it will be understood that other compressed gases such as nitrogen may be used instead; and indeed the raised and decreased pressures may alternatively be generated by devices such as compressors or vacuum pumps.

It will also be appreciated that the pig may differ from that described above, and for example may consist of flexible plastic disks linked by a rod. Furthermore the tubes 14 and 16 may be rigid pipes rather than flexible tubes, although flexible tubes are much more convenient to install where samples are to be obtained from a depth of more than a few meters.

The apparatus 10 may be used in a range of different contexts. In one example it may be used in measurements to assess if radioactive material is migrating in groundwater from a radioactive waste disposal site, by monitoring for the presence of any radioactive materials in the water in boreholes or wells around the site. Where it is necessary to first empty the borehole, this can be achieved by repeating the steps described above repeatedly until sufficient water has been removed.

We claim:

1. An apparatus for raising a sample of liquid from a lower level to a higher level, said apparatus comprising a pair of flexible tubes extending alongside each other for extending from the higher level to the lower level, each of said tubes being of uniform bore along its length, a connector linking said tubes at their lower end for defining a generally U-shaped duct, a pig insertable into a first one of said tubes at an upper end thereof and movable along the length of said first tube to a resting position near the bottom of said first tube, said pig being liquid-impermeable and being in contact with the wall of said first tube, means at the upper end of said apparatus for adjusting the pressure in each of said tubes for urging said pig to move either up or down in said first tube in accordance with the applied pressures, and a valve communicating between the inside and outside of said first tube near its lower end but above the resting position of said pig.

2. An apparatus as defined in claim 1 wherein said valve is a nonreturn valve.

3. An apparatus as defined in claim 1 wherein said pig is of generally cylindrical shape.

4. An apparatus as defined in claim 3 wherein said pig comprises a cylindrical block of a dense plastic foam, and end plates of a flexible polymeric material are affixed to said pig for providing a seal with the wall of said first tube.

5. A method for raising a sample of liquid from a lower level to a higher level, using an apparatus comprising a pair of flexible tubes extending alongside each other, linked by a connector at one end, the tubes being of uniform bore along their length, so that the tubes and the connector define a generally U-shaped duct, a valve communicating between the inside and outside of one of the tubes near said one end, a liquid-impermeable pig insertable into a first one of the tubes at its other end, and means at the said other end for adjusting the pressure in each tube;

said method comprising the steps of:

arranging the tubes so that the connector is at the lower level, inserting a pig into said first one of said tubes for providing a seal with the inside wall of the first tube, adjusting pressures within said tubes for moving the pig to a resting position near the lower end of the first tube adjacent to the connector but below the valve, causing liquid to enter the tube through the valve, and adjusting the pressures within the tubes for moving the pig upwardly for pushing the liquid that has entered the tube to the upper end of the first tube, wherein the step of adjusting pressures is performed by utilizing a source of compressed gas for raising the pressure, and a jet pump for decreasing the pressure.

* * * * *